United States Patent [19]

Neilsen

[11] 3,987,695

[45] Oct. 26, 1976

[54] HOLE PUNCH DEVICE FOR SELECTIVELY PUNCHING DIFFERENT ARRAYS OF HOLES IN SHEET MATERIAL

[76] Inventor: Hildaur L. Neilsen, 2 Juniper St., Metuchen, N.J. 08840

[22] Filed: Dec. 22, 1975

[21] Appl. No.: 642,990

[52] U.S. Cl. ..... 83/522; 83/560; 83/628; 83/700

[51] Int. Cl.[2] ..... B26F 1/02

[58] Field of Search ..... 83/560, 522, 558, 562, 83/628, 700

[56] References Cited

UNITED STATES PATENTS

| | | | |
|---|---|---|---|
| 2,079,437 | 5/1937 | Ehret | 83/560 |
| 2,415,539 | 2/1947 | Segal | 83/560 |
| 2,756,822 | 7/1956 | Jones | 83/560 X |

*Primary Examiner*—Frank T. Yost
*Attorney, Agent, or Firm*—Robert Henderson

[57] ABSTRACT

A single punch head is slidable along a multi-faced, rotatable, horizontal bar having different arrays of detents on its several faces; a spring-pressed ball coacting successively with the detents on any selected face of the bar to position the head for punching holes spaced correspondingly to the detent spacing on the selected face. The ball also serves to hold the bar somewhat yieldably in any of the plural face positions to which the bar may be turned.

9 Claims, 4 Drawing Figures

HOLE PUNCH DEVICE FOR SELECTIVELY PUNCHING DIFFERENT ARRAYS OF HOLES IN SHEET MATERIAL

BACKGROUND OF THE INVENTION

Some punch devices have hitherto been provided with a single punch head, or with plural independently operable punch heads, slidable along a non-rotatable bar having an array of detents in a single face thereof for locating and holding a punch head successively in positions corresponding to the desired positions for holes to be punched in a line on paper or the like. Where, in such prior devices, an array of detents is provided of sufficient number to serve for plural arrays of holes, the user must very carefully select from the plural detents those that will serve to provide the desired array of holes in the sheet material being punched. In selecting those detents to be utilized, he must be sure not to utilize any of the detents which are not related to the particular array of holes to be punched. In such operation the user may easily become confused as to the proper detents to be used, and often will punch holes that are not desired thus spoiling many sheets of the material being processed by the device

MAIN OBJECT OF THIS INVENTION

The principal object of this invention is to provide a punch device having a single punch head upon which considerable force is applied to enable it to punch holes successively in a linear array in a relatively thick stack of paper or the like; the device having the facility of punching holes in succession in any selected one of a multiplicity of linear hole arrays which the device is capable of providing.

The just stated objective is derived by use of a punch device such as is set forth in the foregoing abstract, particularly a device having the mentioned multi-faced rotatable bar along which the punch head is slidable successively to plural punching positions identified by detents in the bar.

Assuming, for example, that the bar has six faces, the device provides for the selective forming separately of six different hole arrays, each face having detents operable only in providing for a single one of six possible hole arrays. Thus, the user, after rotating the bar to make a selected face thereof operable, is not confronted with detents to be avoided as not being applicable for the hole array for which the bar has been rotated.

BRIEF DESCRIPTION OF THE ACCOMPANYING DRAWING

DETAILED DESCRIPTION OF THE ILLUSTRATED DEVICE

The Device's Frame

Figure 1:
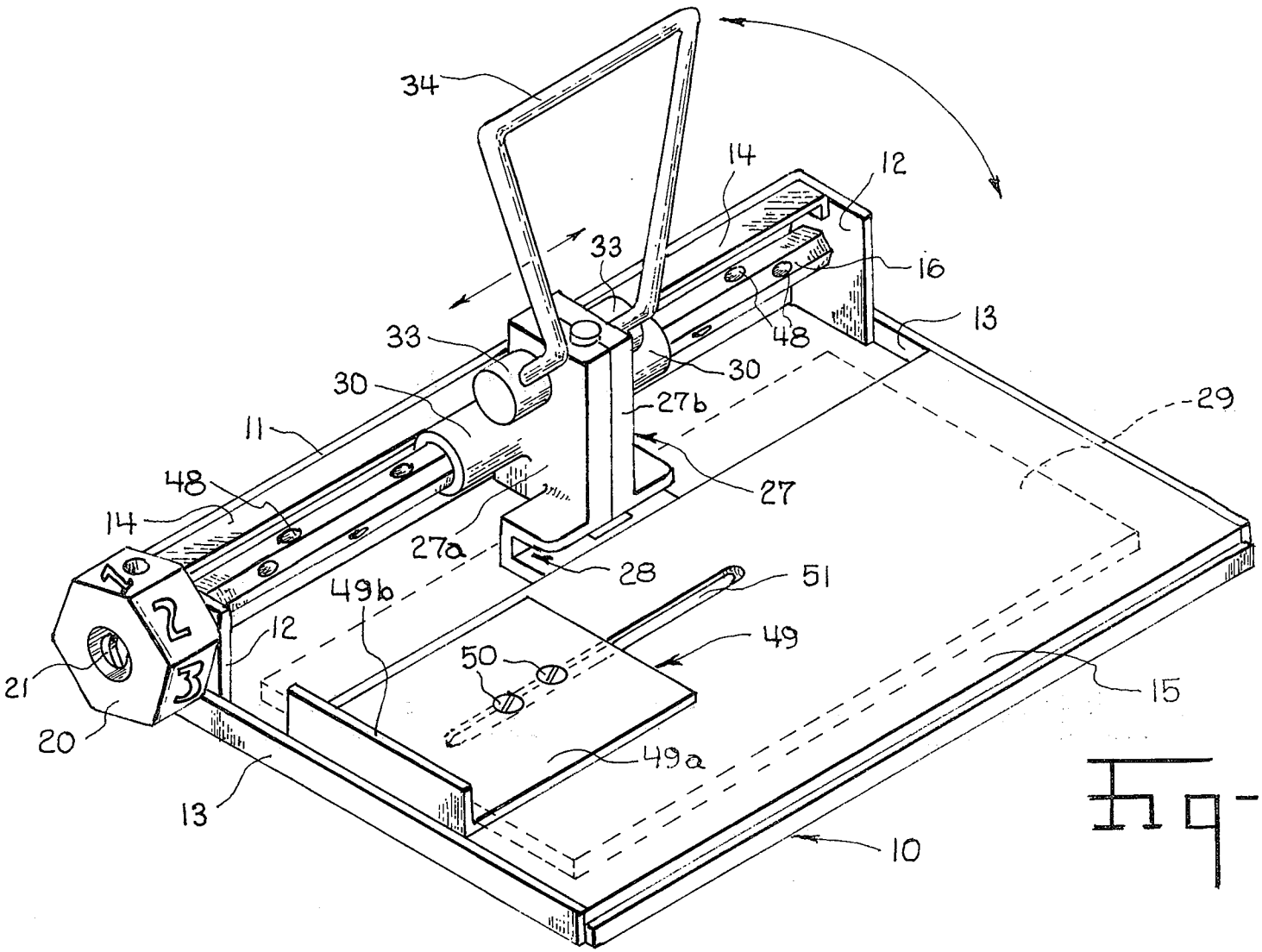
FIG. 1 is a perspective view of a preferred embodiment of a hole punch according to the present invention.

As best generally illustrated in FIG. 1, a frame or base 10 in the form of a shallow rectangular box is provided with an integral back 11 formed with forwardly and upwardly extending side members 12. Lower portions of said side members are fixed to upright side flanges 13 of the base, and upper portions of said side member are rigidly interconnected by a top member 14.

The forward part of the base 10 is covered by a generally flat paper support 15 which is suitably so mounted upon the base as to be held against horizontal movement thereon and at such a height as to support a stack of paper properly for processing by having holes punched thereinto as hereinafter described. The base 10 and its appurtenances as thus far detailed are preferably formed of suitable sheet metal.

The Multi-Faced Bar and its Mounting

Figure 4:
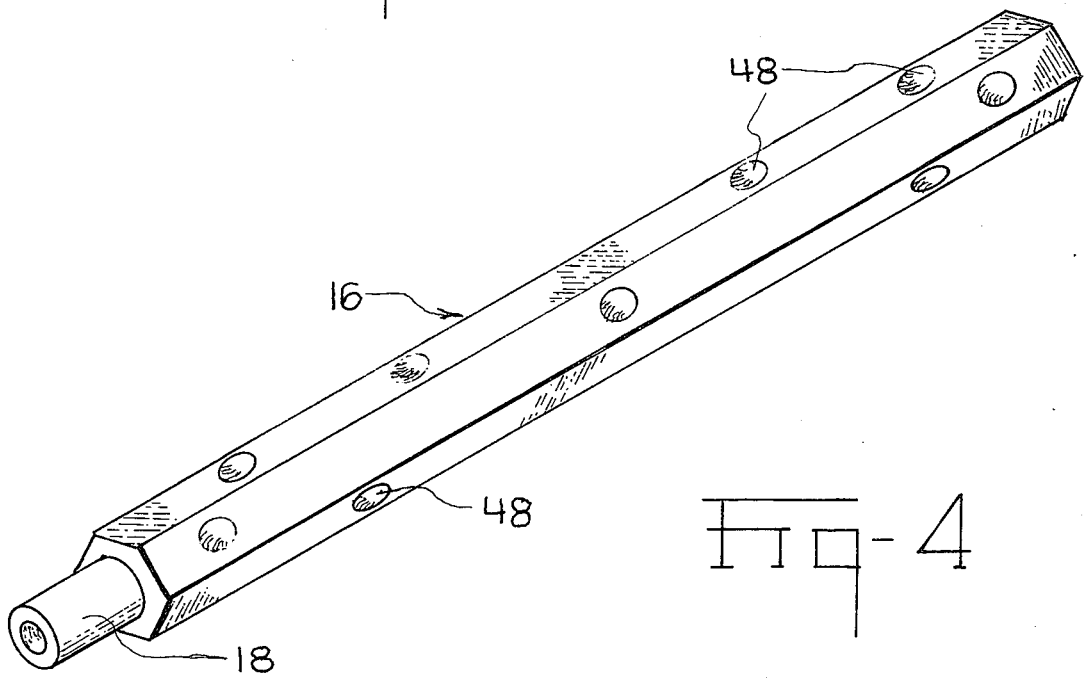
FIG. 4 is a perspective view of a multi-faced, rotatable bar of the device upon and along which a punch head of the device is slidable.

An elongate steel bar 16 of hexagonal shape in cross section, specifically illustrated in FIG. 4, is suitably borne at opposite ends in directly opposed bearing openings 17 formed in the two side members 12. Although various bearing arrangements are available, the bar 16 is shown at its left end with an integral bearing extension 18 which extends through adjacent bearing opening 17. Said extension fits into a central bore 19 in a hexagonal knob 20 which is held upon said extension by a screw 21. A radial set screw 22 in said knob engages the bearing extension 18 to hold the knob firmly with its six sides in register with the six sides of the bar 16. The knob 20 has suitable identifying indicia thereon such as, for example, the numbers 1 to 6 (only numbers 1 to 3 being visible in the drawing).

The right extremity of the bar 16 is flat and is supported for rotation by a bearing bushing 23 having an inner neck 24 and an outer flange 25. The neck 24 extends rotatably through the adjacent bearing opening 17 while the flange 25 overlies the latter opening's marginal surface of the adjacent side member 12. The bushing 23 is held upon the bar 16 by an axial screw 26.

The Punch Head

Figure 2:
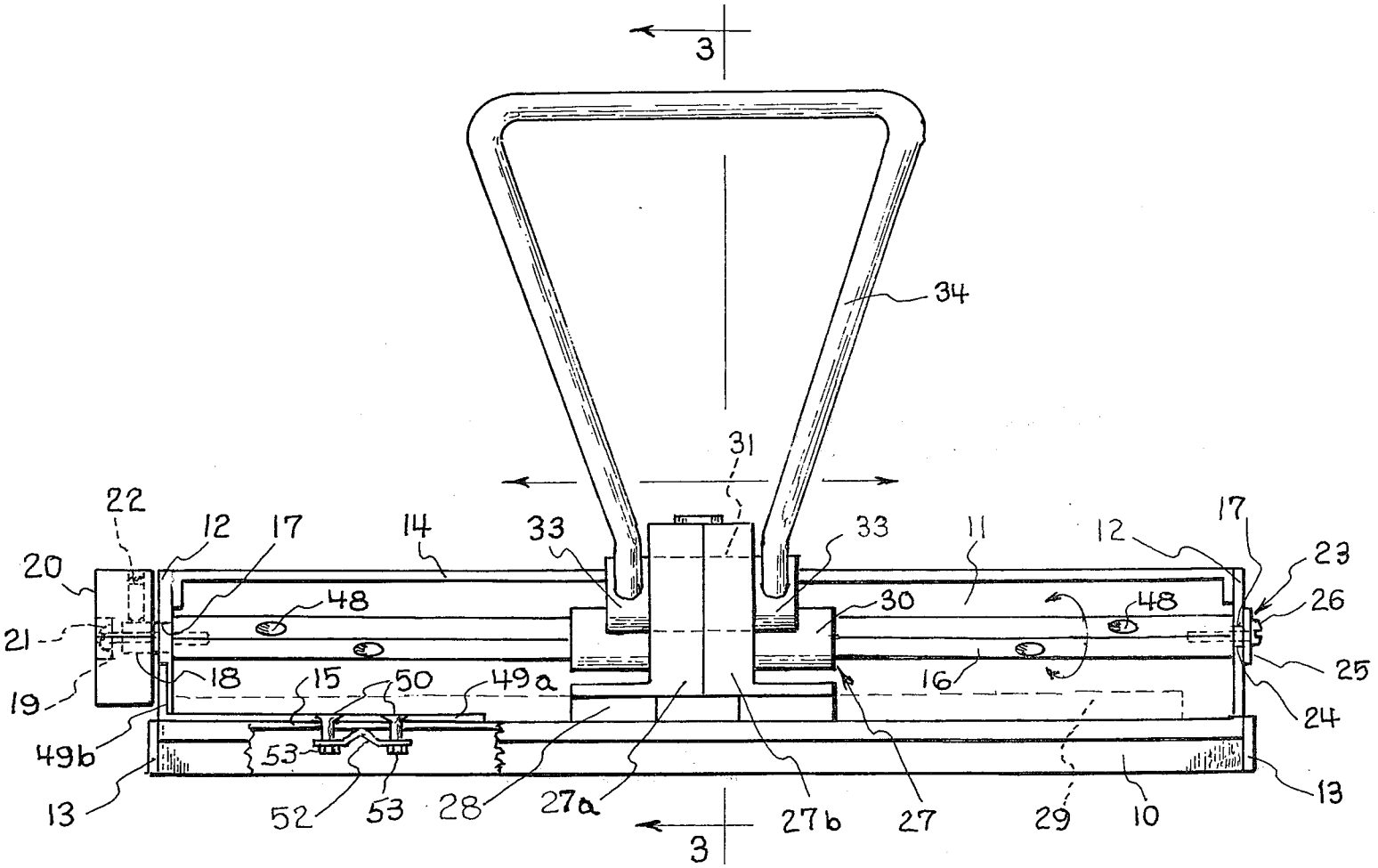
FIG. 2 is a front elevational view of the hole punch illustrated in FIG. 1.
Figure 3:
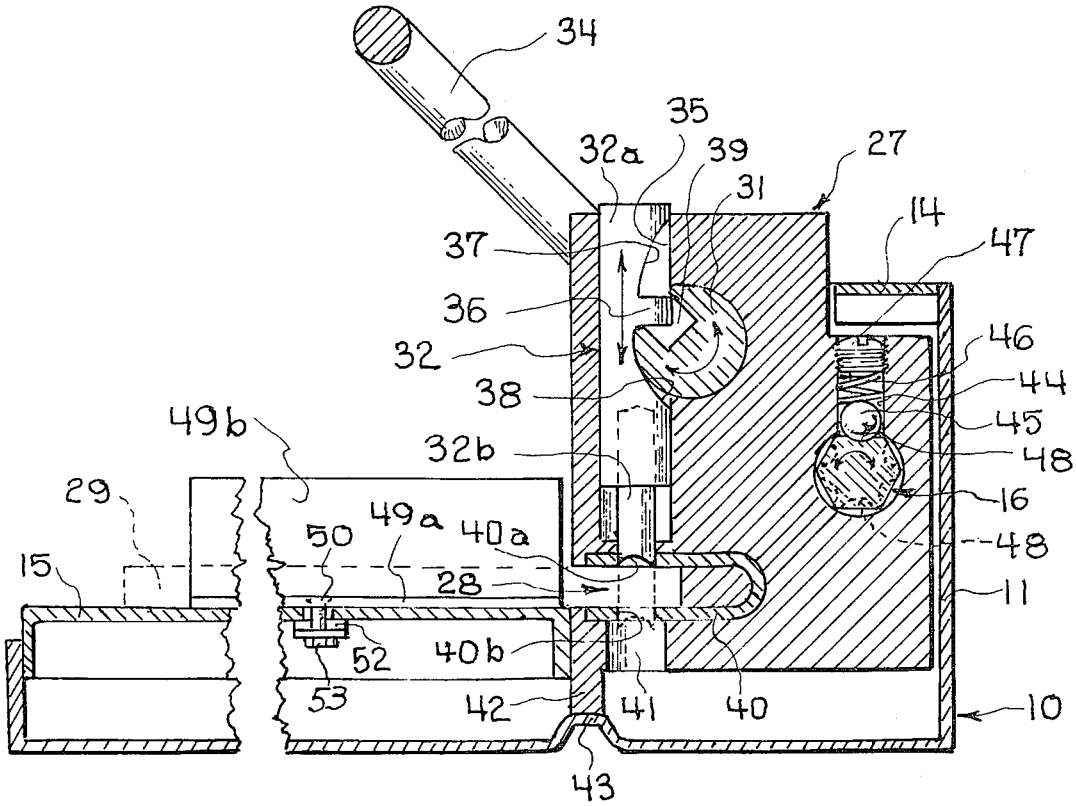
FIG. 3 is an enlarged, front-to-back vertical sectional view substantially on the line 3—3 of FIG. 2.

A single punch head 27 is carried on the bar 16 for sliding along the latter as generally shown in FIGS. 1 and 2 and illustrated in more detail in FIG. 3. To facilitate assembly of the punch head it may be constructed of two oppositely formed but otherwise substantially similar parts 27*a* and 27*b*.

Treating the two parts 27*a* and 27*b* as a single unit for the purpose of this description, the punch head 27 is formed with a forwardly opening mouth 28 at its lower end for receiving a marginal portion of a stack 29 of paper or other sheet material to be punched, oppositely extending horizontal sleeves 30 toward the back of the head 27, serving partly as bearing means for the bar 16 and conversely enabling the latter to support the punch head 27 at its back, and a limitedly rotatable cam shaft 31 for operating a hole punching plunger 32 as hereinafter explained.

Opposite ends 33 of the cam shaft 31 protrude from the punch head 27, and opposite ends of an operating handle 34 are suitably fixed to the cam shaft ends 33 to enable a user to operate the punching plunger 32.

As may best be understood from FIG. 3, the plunger 32 is vertically slidable in a vertical bore 35 formed in the punch head 27. Said plunger may advantageously comprise an upper or body portion 32*a* and a lower or hole cutting portion 32*b* held tightly within the body portion 32*a*. Both of said plunger portions should be of suitably hardened steel.

One side of the body portion 32*a* is cut away as shown to form a cam engaging cross rib 36 and curved open areas 37 and 38 immediately above and below said cross rib. The cam shaft 31 is centrally cut away directly opposite to the cross rib and curved open areas of the plunger's body portion 32*a* to form a slot 39 for engaging the cross rib 36 to move the plunger 32 up and down in response to rotation of the cam shaft back and forth to the extent of approximately 90°.

A U-shaped insert 40 of suitably hardened steel is fixed into the punch head 27 within the latter's mouth, and is formed with aligned holes 40*a* and 40*b* which coact with the lower end of the plunger's cutting portion 32*b* to cut a hole in the stack 29 when the plunger is forced downwardly to its broken line position by downward movement of the handle 34. After the hole has been cut, the handle 34 is raised to withdraw the plunger portion 32*b* from the stack. The punchings drop through a bottom opening 41 into the underlying open area in the base 10.

While, as already indicated, the back of the punch head 27 is supported by the bar 16, the front of the punch head has a depending flange 42 which rests slidably upon the crest of a transverse ridge 43 pressed up from the bottom of the base 10 to give support to the front of the punch head.

Means for Selectively Punching Various Arrays of Holes in the Stack of Sheet Material Six different arrays of detents 48 are provided in the six sides of the bar 16, the spacing of the detents in each array corresponding to six different arrays of holes which may be punched in a stack of sheet material so that, by turning said bar to bring any selected side thereof to an uppermost position, the punch head may successively punch holes corresponding to the detents in said uppermost side of the bar 16.

Proper correlation of the punch head successively to the detents in any selected side of the bar 16 is derived by provision of a steel ball 45 mounted in a vertical bore 44 and biased downwardly by a compression spring 46 held in place in said bore by a screw plug 47. As the punch head 27 is manually slid along the bar 16 in punching a selected array of holes, the ball 45 is urged successively into the detents 48 of the selected side of the bar 16, thereby assuring that the holes being punched will be precisely located in the desired array.

Detents 48 are shown on the three visible sides of the bar 16 in FIG. 4; and similar but differently spaced detents would ordinarily be provided in the three sides of said bar which are not visible in said figure. The user, of course, can readily turn the bar 16 to bring any selected side thereof into operative position, the ball 45, during such turning, riding over the preferably slightly rounded angular ridges of said bar. Thus, the ball 45 serves both to locate the head properly for punching a desired array of holes and to properly index the bar to any of the six angular positions to which it may be turned.

A paper guide 49, preferably of relatively thin sheet metal, is formed with a flat base portion 49*a* resting on the paper support 15 in position to underlir the stack 29, and a side flange 49*b* for engaging one side of said stack. The guide 49 is slidable sidewisely upon the paper support and is constrained to linear movement by studs 50 fixed into the paper guide's base portion and extending downwardly through a transverse slot 51 in the paper support. A tensioned leaf spring 52 is engaged at its opposite ends by nuts 53 on the lower ends of the studs 50, thereby being biased against the under side of the paper support at opposite sides of said slot. While the paper guide 49 may be manually slid to properly position different sizes of stacks on the paper support 15, the spring 52 holds a stack against accidental shifting during hole punching operations.

It should be apparent that various structural variations may be employed in the disclosed hole punch device without, however, departing from the present invention as set forth in the following claims.

I claim:

1. A hole punch device comprising a frame, a multi-faced bar rotatably carried by said frame in a horizontal position, a punch head slidable along said bar, plural punch head positioning means on plural faces of said bar, and said punch head including positioning means; said positioning means of each of said plural faces selectively coacting separately with said positioning means of the punch head to position the latter successively in plural hole punching positions.

2. A hole punch device according to claim 1, said positioning means on said bar comprising plural, similar radial deformations of said bar, and said positioning means of said punch head comprising a yieldable element adapted for yielding engagement separately with said deformations.

3. A hole punch device according to claim 2, said deformations being detents and said punch head including a spring coacting with said yieldable element to urge the latter into any registering one of said detents.

4. A hole punch device according to claim 1, said positioning means of said bar being differently spaced along said different faces and rotation of said bar serving to enable any selected one of said faces to be brought into such an angular position as to enable said positioning means of the selected face to coact with said positioning means of the punch head.

5. A hole punch device according to claim 1, said bar being borne in said punch head toward the latter's rear, thereby supporting the punch head at its rear.

6. A hole punch device according to claim 1, said positioning means of the bar being frusto-spherical depressions, and said positioning means of said punch head being a spring-pressed ball in the punch head adapted to engage yieldably in any one of said depressions.

7. A hole punch device according to claim 6, said bar's plural faces being delineated by ridges extending longitudinally of the bar, and said ball being adapted to ride over said ridges upon turning of the bar and to firmly engage a related face of the bar to hold the latter substantially in any adjusted angular position thereof relatively to said punch head.

8. A hole punch device according to claim 1, said punch head having a single operative hole punching plunger, limiting the operation of the punch head to the punching of only one hole at a time in a supply of sheet material.

9. A hole punch device according to claim 1, further comprising a knob fixed to one end of said multi-faced bar for turning the latter, said knob having plural, indicia-identified faces corresponding to the plural faces of said bar.

* * * * *